US008070158B2

(12) United States Patent
Fan et al.

(10) Patent No.: US 8,070,158 B2
(45) Date of Patent: Dec. 6, 2011

(54) ELECTRONIC DEVICE WITH PAPER SORTING APPARATUS

(75) Inventors: Chen-Lu Fan, Taipei Hsien (TW); Chih-Kun Shih, Santa Clara, CA (US); Chun-Hsien Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/728,645

(22) Filed: Mar. 22, 2010

(65) Prior Publication Data

US 2011/0133401 A1 Jun. 9, 2011

(30) Foreign Application Priority Data

Dec. 3, 2009 (CN) ..... 2009 1 0310783

(51) Int. Cl.
*B65H 29/00* (2006.01)

(52) U.S. Cl. ..... 271/292; 271/294

(58) Field of Classification Search ..... 271/292, 271/294; 211/126.2, 126.4, 59.4; 312/312, 312/306; 108/144.11, 147, 106
See application file for complete search history.

(56) References Cited

U.S. PATENT DOCUMENTS

| | | | | |
|---|---|---|---|---|
| 4,568,132 | A * | 2/1986 | Watt | 312/312 |
| 5,289,782 | A * | 3/1994 | Rizzi et al. | 108/147 |
| 6,312,069 | B1 * | 11/2001 | Weng | 312/312 |
| 6,494,150 | B1 * | 12/2002 | Phoenix et al. | 108/147 |
| 6,568,675 | B1 * | 5/2003 | Boss | 271/292 |
| 6,712,008 | B1 * | 3/2004 | Habenicht et al. | 108/96 |
| 2005/0045077 | A1 * | 3/2005 | Bober | 108/147 |

FOREIGN PATENT DOCUMENTS

JP 06016331 A * 1/1994

* cited by examiner

*Primary Examiner* — Kaitlin Joerger
(74) *Attorney, Agent, or Firm* — Altis Law Group, Inc.

(57) ABSTRACT

An electronic device includes a main body and a plurality of paper trays. The main body includes a mounting plate, and the mounting plate defines a paper outlet. A mounting bracket is secured to the main body. A control module is disposed on the mounting bracket. A driving member is connected to the paper trays. The control module is capable of causing the driving member to move the paper trays along a direction parallel to the mounting plate, so that one of the paper trays is aligned with the paper outlet.

18 Claims, 3 Drawing Sheets

ELECTRONIC DEVICE WITH PAPER SORTING APPARATUS

BACKGROUND

1. Technical Field

The present disclosure relates to electronic devices with paper sorting apparatuses.

2. Description of Related Art

Often printers will have many print jobs to process, in a short time, that may come from many different users. Thus it is helpful to have print jobs sorted for easy retrieval by users. However, present paper sorters are complicated and expensive.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
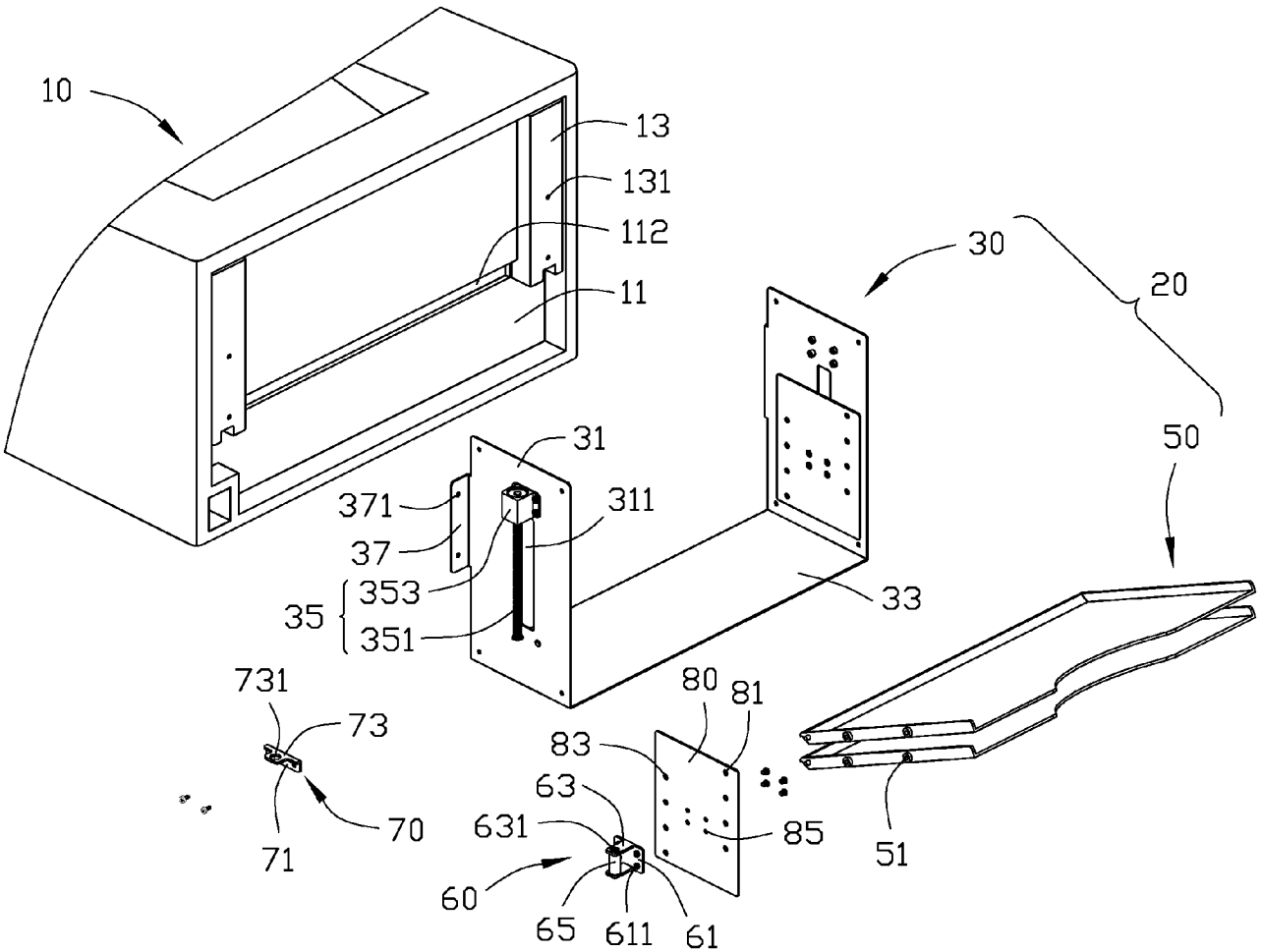
FIG. 1 is an exploded, isometric view of an electronic device with a paper sorting apparatus in accordance with an embodiment.

Referring to FIG. 1, an electronic device includes a main body 10 configured to print files, and a paper sorting apparatus 20 connected to the main body 10.

The main body 10 includes a mounting plate 11. The mounting plate 11 defines a paper outlet 112 for paper output. Two securing plates 13 are located at two sides of the paper outlet 112. Each securing plate 13 defines securing holes 131.

The paper sorting apparatus 20 includes a mounting bracket 30 and a plurality of paper trays 50 mounted to the mounting bracket 30.

The mounting bracket 30 includes two opposite sidewalls 31, that are perpendicular to the mounting plate 11 of the main body 10, and a bottom wall 33 connected between the opposite sidewalls 31. Each sidewall 31 defines a slot 311 along a direction perpendicular to the bottom wall 33 of the mounting bracket 30. A control module 35 is disposed on one of the sidewalls 31. The control module 35 includes a screw shaft 351 perpendicular to the bottom wall 33, and a driving motor 353 capable of rotating the screw shaft 351. The screw shaft 351 is aligned with the slot 311. A bent flange 37 extends from one side edge of each sidewall 31. Two securing holes 371 are defined in the bent flange 37.

Each paper tray 50 has two securing posts 51 at each side thereof. In one embodiment, the paper trays 50 are adjustable for fitting different sizes of paper.

The paper sorting apparatus 20 further includes a driving member 60 configured to couple with the screw shaft 351. A blocking member 70 is secured to the sidewall 31, and configured to prevent the driving member 60 disengaging from the screw shaft 351, and a connecting board 80 is secured to the driving member 60.

The driving member 60 includes a base 61 parallel to the sidewall 31 of the mounting bracket 30. The base 61 defines a plurality of base holes 611. Two mounting tabs 63 protrude from two opposite sides of the base 61. A nut 65 is disposed between the two mounting tabs 63. Each mounting tab 63 defines a hole 631 for the screw shaft 351 extending through and engages the nut 65.

The blocking member 70 includes a fixing piece 71, secured to the sidewall 31 of the mounting bracket 30, and a blocking tab 73, extending from the fixing piece 71. A through hole 731 is defined in the blocking tab 73.

In one embodiment, the connecting board 80 is substantially rectangular. A set of first mounting holes 81 and second mounting holes 83 are defined in the connecting board 80. A plurality of third mounting holes 85 is defined between the first mounting holes 81 and the second mounting holes 83. In FIG. 1, only two paper trays 50 are shown. In other embodiments, the amount of the paper trays 50 can be changed according to need.

Figure 2:
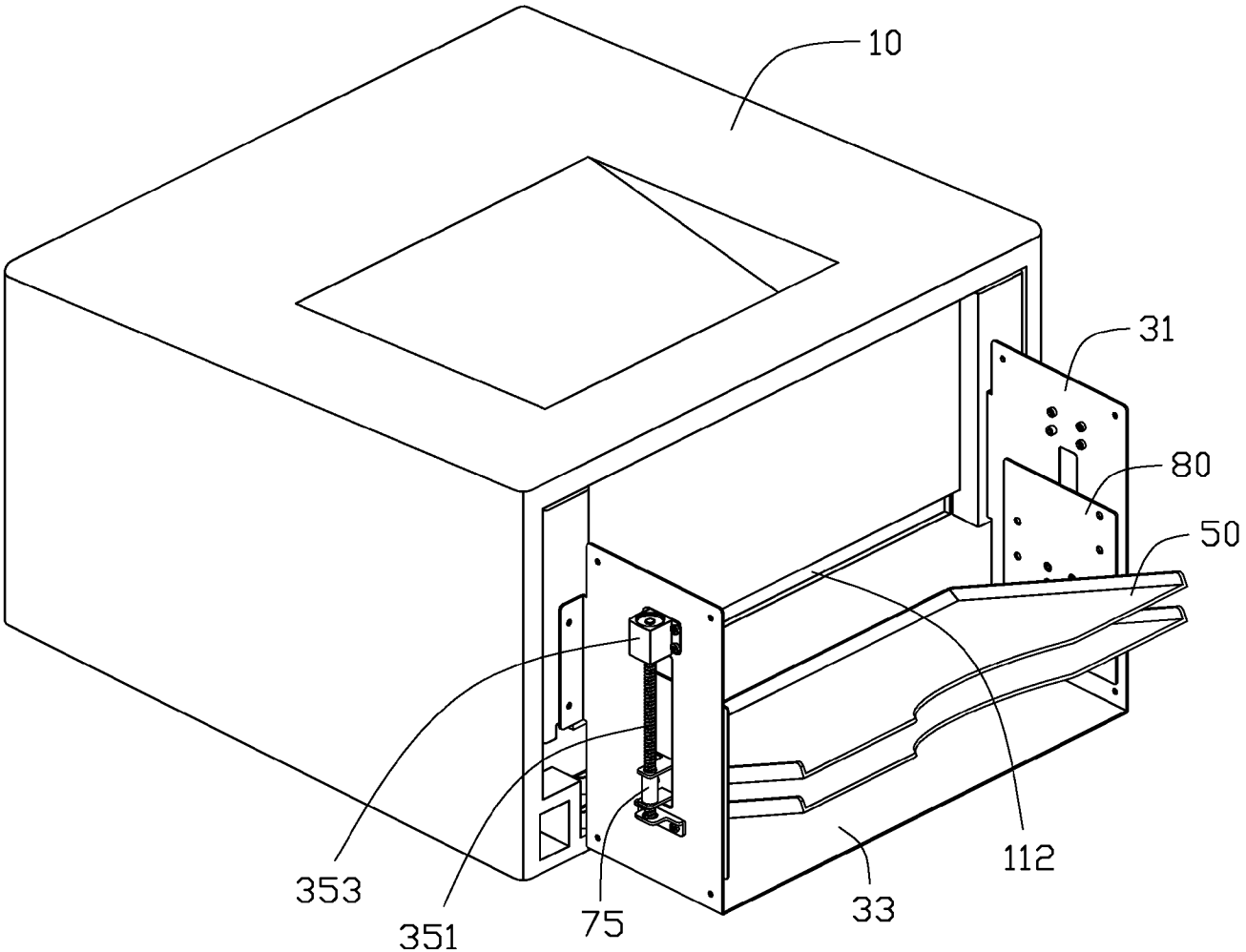
FIG. 2 is an assembled view of FIG. 1.
Figure 3:
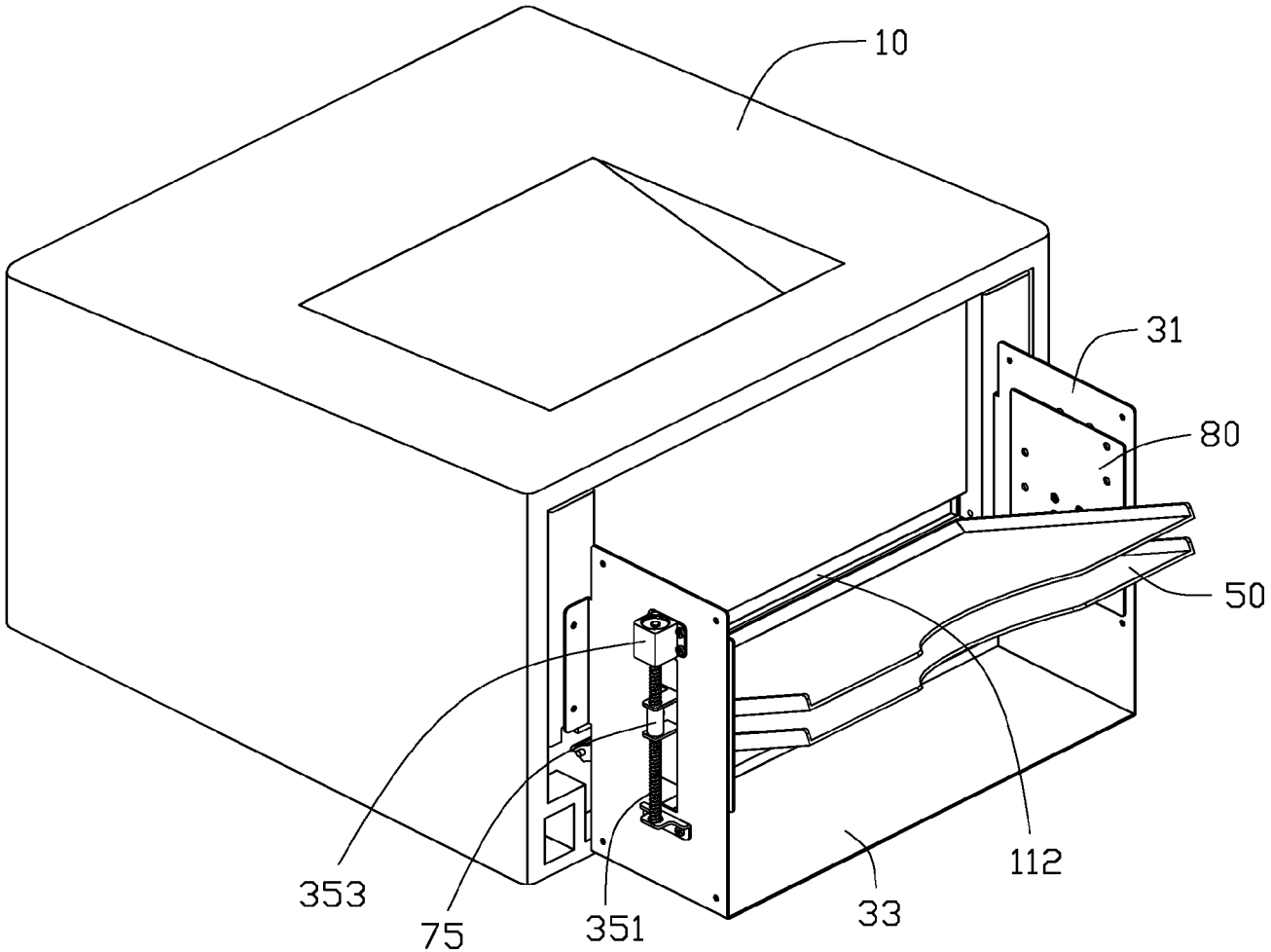
FIG. 3 is similar to FIG. 2, but showing the paper trays in a different position.

Referring to FIGS. 2 and 3, in assembly, the bent flanges 37 of the mounting bracket 30 are secured to the securing plates 13. The mounting tabs 63 and the nut 65 of the driving member 60 extend through the slot 311 from an inner side of the sidewall 31. The base 61 abuts and is secured to the sidewall 31. The fixing piece 71 of the blocking tab 73 is secured to the sidewall 31. The screw shaft 351 extends through the nut 65 and the through hole 731 in the blocking tab 73. The securing posts 51 of each paper tray 50 are secured to a corresponding first mounting hole 81 and a second mounting hole 83, so that the paper trays 50 are angled toward the mounting plate 11 of the main body 10.

In use, the main body 10 sends commands to the control module 35 to run the driving motor 353, thereby driving the screw shaft 351 to rotate. Thus, the nut 65 of the driving member 60 moves along the screw shaft 351 in a direction parallel to the securing plate 13 of the main body 10, and perpendicular to the bottom wall 33 of the mounting bracket 30. The driving member 60 moves the connecting board 80 along the sidewall 31 of the mounting bracket 30. The paper trays 50 are moved with the connecting board 80, so that one of the paper trays 50 is capable of coupling with the paper outlet 112 (shown in FIG. 3). When the main body 10 receives a print job, the main body 10 can control one of the paper trays 50 to align the paper outlet 112. When another print job is executed, the control module 35 may move another paper tray 50 to align with the paper outlet 112. Thus, the printed papers can be sorted according to different print jobs.

In an alternative embodiment, a control module 35, a driving member 60, a blocking member 70, and a connecting board 80, are arranged on each of the two sidewalls 31 of the mounting bracket 30.

It is to be understood, however, that even though numerous characteristics and advantages of the embodiments have been set forth in the foregoing description, together with details of the structure and function of the present disclosure, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. An electronic device, comprising:

a main body having a mounting plate, the mounting plate defining a paper outlet;

a mounting bracket secured to the main body, and a control module disposed on the mounting bracket;

a plurality of paper trays; and a driving member secured to the plurality of paper trays, wherein the control module causes the driving member and the plurality of paper trays to move along a direction parallel to the mounting plate relative to the control module, to align one of the plurality of paper trays with the paper outlet.

2. The electronic device of claim 1, wherein the plurality of paper trays are connected to the driving member via a connecting board.

3. The electronic device of claim 2, wherein the control module comprises a screw shaft and a driving motor capable of causing the screw shaft to rotate, and a nut coupled to the screw shaft.

4. The electronic device of claim 3, wherein the mounting bracket comprises a sidewall, a slot is defined in the sidewall, and the nut extends through the slot and is coupled with the screw shaft.

5. The electronic device of claim 3, wherein the driving member further comprises a base secured to the connecting board, two mounting tabs extends from the base, and the nut is disposed between the two mounting tabs.

6. The electronic device of claim 5, wherein each of the two mounting tabs defines a hole, and the screw shaft is inserted through the holes and engage with the nut.

7. The electronic device of claim 2, wherein each paper tray comprises two securing posts, the connecting board defines two securing holes, and the two securing posts engage with the two securing holes.

8. The electronic device of claim 1, wherein the plurality of paper trays are angled toward the mounting plate of the main body.

9. The electronic device of claim 4, wherein a blocking member is secured to the sidewall of the mounting bracket and located beneath the driving member, and the screw shaft is disposed between the driving motor and the blocking member.

10. An electronic device, comprising:

a main body having a mounting plate, the mounting plate defining a paper outlet;

a mounting bracket secured to the main body, the mounting bracket comprising two sidewalls;

a control module, disposed on the mounting bracket, comprising a screw shaft and a driving motor;

a plurality of paper trays disposed between the two sidewalls of the mounting bracket, and one of the paper trays aligned to the paper outlet; and a driving member secured to the plurality of paper trays, the driving member is rotatable attached to the screw shaft, the driving motor is adapted to drive the screw shaft to rotate, and the screw shaft is capable of pushing the driving member and the plurality of paper trays to move along a direction parallel to the mounting plate relative to the screw shaft.

11. The electronic device of claim 10, wherein the plurality of paper trays are connected to the driving member via a connecting board.

12. The electronic device of claim 11, wherein the control module is mounted to one of the sidewalls of the mounting bracket, and a nut coupled to the screw shaft.

13. The electronic device of claim 12, wherein the mounting bracket comprises a sidewall, a slot is defined in the sidewall, and the nut extends through the slot and is coupled with the screw shaft.

14. The electronic device of claim 12, wherein the driving member comprises a base secured to the connecting board, two mounting tabs extends from the base, and the nut is disposed between the two mounting tabs.

15. The electronic device of claim 14, wherein the two mounting tabs each defines a hole, and the screw shaft is inserted through the holes and engages with the nut.

16. The electronic device of claim 11, wherein each paper tray comprises two securing posts, the connecting board defines two securing holes, and the two securing posts engage with the two securing holes.

17. The electronic device of claim 10, wherein the plurality of paper trays are angled toward the mounting plate of the main body.

18. The electronic device of claim 10, wherein a blocking member is secured to one of the sidewalls of the mounting bracket and located beneath the driving member, and the screw shaft is disposed between the driving motor and the blocking member.

* * * * *